United States Patent [19]

Rimppi et al.

[11] 4,135,469

[45] Jan. 23, 1979

[54] METHOD FOR REDUCING PROPELLER NOISE

[75] Inventors: Martti Rimppi, Tapiola; Olavi Turunen, Helsinki, both of Finland

[73] Assignee: Oy Wartsila AB, Helsinki, Finland

[21] Appl. No.: 780,996

[22] Filed: Mar. 24, 1977

Related U.S. Application Data

[63] Continuation of Ser. No. 433,497, Jan. 15, 1974, abandoned.

[30] Foreign Application Priority Data

Jan. 19, 1973 [FI] Finland ..... 73136

[51] Int. Cl.[2] ..... B63B 35/00

[52] U.S. Cl. ..... 114/270; 114/67 A

[58] Field of Search ..... 114/67 R, 67 A, 150, 114/151, 270; 181/33 B

[56] References Cited

U.S. PATENT DOCUMENTS

| | | | |
|---|---|---|---|
| 1,254,892 | 1/1918 | Elniff | 114/67 A |
| 3,084,651 | 4/1963 | Parmenter | 114/270 |

FOREIGN PATENT DOCUMENTS

| | | | |
|---|---|---|---|
| 322705 | 4/1970 | Sweden | 114/67 A |

*Primary Examiner*—Trygve M. Blix
*Assistant Examiner*—Jesus D. Sotelo
*Attorney, Agent, or Firm*—Haseltine, Lake & Waters

[57] ABSTRACT

A method and a device for blowing gaseous medium between the propeller and the hull of a ship the vibration and noise caused in the ship by its driving propeller is considerably reduced. In order to optimize the application of this noise reducing method the total flow Q of the gaseous medium blown out should, expressed in normal cubic meters per hour, satisfy a special formula.

6 Claims, 4 Drawing Figures

METHOD FOR REDUCING PROPELLER NOISE

Figure 2:
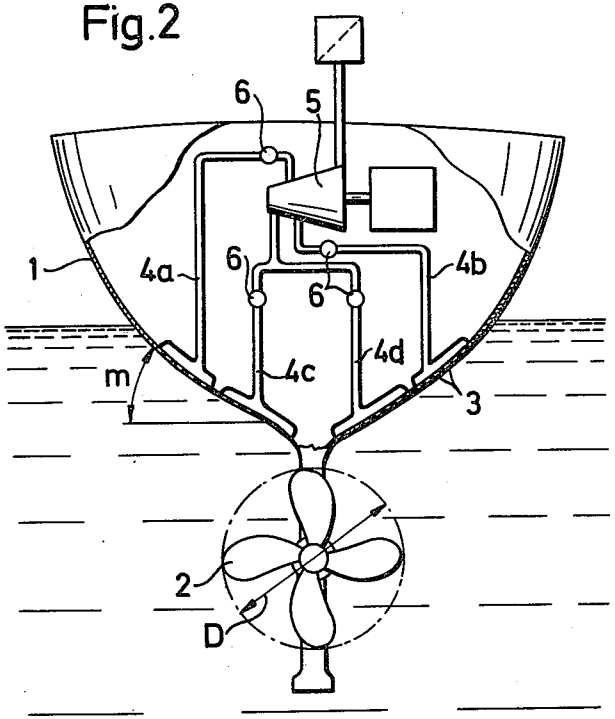

This is a continuation of application Ser. No. 433,497 filed Jan. 15, 1974 now abandoned.

The invention relates to a method for reducing the vibration and noise caused in a ship by the propeller of the ship by blowing gas, especially air, between the propeller and the hull of the ship.

The reduction of the propeller noise with an air cushion between the propeller and the hull of the ship is known per se from the Swedish patent No. 322,705. No detailed information is however given of how this idea should be applied, it is only mentioned more in the form of a general principle.

Extensive research and tests have shown that the amounts of gas or air used when applying the known air blowing method have a decisive effect on the quality and economy of the result. The invention aims to optimize the method known per se and to indicate how the air or gas blowing equipment should be dimensioned in order to achieve the best results.

The method according to the invention is characterized in that the total flow Q of the gas blown out into the space between the propeller or propellers and the hull of the ship expressed in normal cubic meters per hour conforms with the following formula:

$$B \cdot D/Q \cdot 3\sqrt{P/S \cdot Z} < 0.4$$

wherein

B (if S = 1) = the cosine of the angle of inclination of the outer surface of the hull of the ship as measured in a cross-sectional plane, at the gas blowing openings, at least 0.6

B (if S ≧ 2) = S

P = the output power of the ship's machinery in shaft horse powers

S = the number of the propellers

Z = the blade number of each propeller

D = average diameter of the propeller in meters

It has proved advantageous when applying the method according to the invention to a ship with an inclined outer hull surface above the propeller, to divide the feed system of the blowing openings into groups, for instance with valves, so that at least the openings located mainly at the same level belong to the same feed group, preferably separately on both sides. Thus proper feeding pressure can be set for every feed group. The differences in hydrostatic pressure on different depth levels in the water can be compensated also by making the diameter of the blowing openings different in dependance on the distance of each opening from the water level so that the lower openings are made larger than the upper ones.

By choosing the size of the openings suitably it is possible to compensate for flow differences, due to different discharge speeds caused by unequal hydrostatic pressure outside the openings. This solution can advantageously be used in cases where the level difference of the blowing openings of a feed group is about 1 meter.

The gas or air blowing openings are located forwards from the propeller, whereby the distance between the propeller and the blowing openings is of considerable importance for the function of the system. A suitable distance between the blowing openings and the propeller plane is about 0.25 to 0.6 times the propeller diameter. The best results are usually achieved if said distance is 0.3 to 0.5 times the propeller diameter. The blowing openings are advantageously located mainly in the same cross-sectional plane of the ship.

Figure 1:
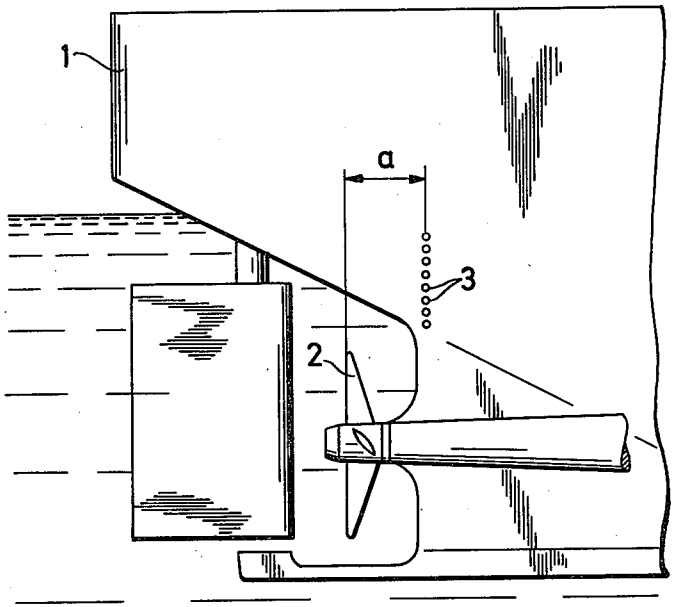
Figure 4:
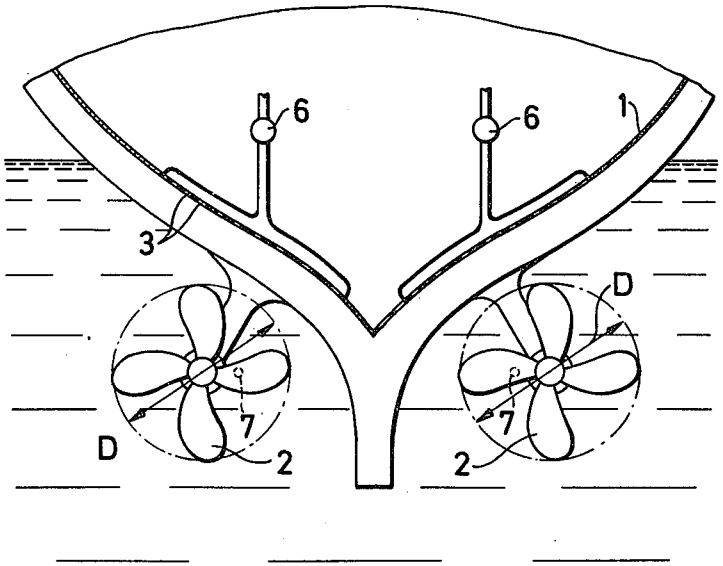
Figure 3:
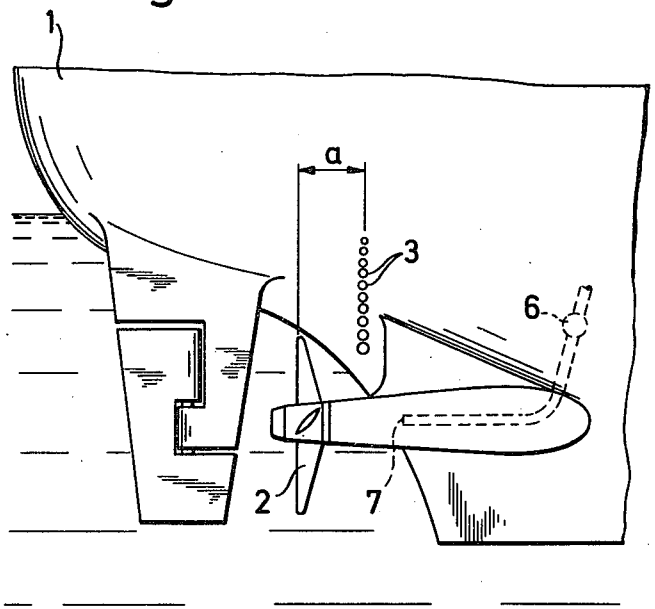

The invention will now be more fully described with reference to the attached drawing, wherein FIG. 1 is a side view of the stern of a one-propeller ship according to the invention FIG. 2 is a cross-section of the ship of FIG. 1, FIG. 3 is a side view of the stern of a two-propeller ship according to the invention and FIG. 4 is a cross-section of the ship of FIG. 3.

In the drawing, 1 indicates the hull of the ship, 2 the propeller and 3 the air blowing openings. The outer surface of the hull usually is inclined above the propeller and this has a certain effect on the flow needed in the gas blowing, especially in one-propeller ships. This effect is taken into account by measuring the average angle of inclination m of the outer surface of the hull in a cross-section of the ship at the blowing openings, and by using the cosine of this angle as the factor B in the formula for the flow Q, taking into account the terms given with respect to this formula.

FIG. 2 shows that the blowing openings 3 are divided, for instance, by means of throttle valves 6, into four groups each of which has its own feed system, *4a*, *4b* and *4c*, *4d* respectively. In the feed systems *4a* and *4b*, which are connected to the upper blowing openings, there is a lower pressure than in the feed systems *4c* and *4d* which are connected to blowing openings at a deeper level. The compressed air needed for the blowing can be received, for instance, from a compressor 5. The distribution of the gas into different feed systems can be properly set by means of the valves 6.

In the arrangement shown in FIGS. 3 and 4, no separate feed systems are used on the same side, but the blowing openings are made different in size so that the size of the openings increases with an increasing location depth, so that there will be approximately the same outblowing flow from each of the openings. This idea can also be applied to the different blowing opening groups of the embodiment shown in FIG. 2, but it can also replace the dividing into groups as such, or reduce the number of groups required.

The air blowing openings 3 are located in the same cross-sectional plane of the ship, a little forwards from the propeller. The distance a between the blowing openings and the propeller plane is, in the embodiments shown, about 0.3 times the propeller diameter.

In order to reduce the vibration conducted to the hull of the ship through the rudder, it has proved advantageous to lead a small part of the total gas flow, for instance about 10%, between the rudder and the propeller, for instance, by leading it into the water as shown in FIGS. 3 and 4, through openings 7 at the propeller shaft supports from where the gas flows through the propeller to the space between the propeller and the rudder.

The invention is not limited to the embodiments disclosed, but several variations of the invention are feasible within the scope of the attached claims.

We claim:

1. A ship having at least one driving propeller and an upwardly sloping hull portion above the propeller and including a device for reducing vibration and noise caused in said ship by said driving propeller, said device comprising powered means for forcibly blowing gaseous medium through gas blowing openings into a space between said propeller and the hull of the ship in which gas blowing openings at different levels have different areas in dependence on their location depth, the openings at a deeper level having larger areas, thereby providing a compensation for flow differences due to different discharge speeds caused by unequal hydrostatic pressure outside said openings for overcoming the water pressure outside said openings, said means producing air bubbles in said space and being dimensioned to produce a total flow of said gaseous medium in conformance with the formula:

$$\frac{B \cdot D}{Q} \cdot \sqrt[3]{\frac{P}{S \cdot Z}} < 0.4,$$

wherein, for a single propeller ship

B = the cosine of the average angle of inclination of the outer surface of said hull above said propeller as measured in a cross-sectional plane of said ship through said gas blow openings, at least 0.6

D = the diameter of said propeller, in meters

Q = the total flow of said gaseous medium, in normal cubic meters per hour

P = the power of the drive machinery of said ship, in shaft horsepower

S = 1

Z = the blade number of said driving propeller, and for a multipropeller ship,

D = the average diameter of the driving propellers of said ship, in meters

S = the number of driving propellers of said ship

Z = the blade number of anyone of said driving propellers

B = S, and

P and Q are as defined above for a single propeller ship.

2. A ship having at least one driving propeller and an upwardly sloping hull portion above the propeller and including a device for reducing vibration and noise caused in said ship by said driving propeller, said device comprising powered means for forcibly blowing gaseous medium through gas blowing openings into a space between said propeller and the hull of the ship, said means for blowing gaseous medium having gas blowing openings at different levels, a feed system being provided for said openings and being divided into groups, each group being limited to include openings located substantially at the same level and means for setting a different feed pressure for each group, whereby the water pressure outside said openings is overcome, said means producing air bubbles in said space and being dimensioned to produce a total flow of said gaseous medium in conformance with the formula:

$$\frac{B \cdot D}{Q} \cdot \sqrt[3]{\frac{P}{S \cdot Z}} < 0.4,$$

wherein, for a single propeller ship

B = the cosine of the average angle of inclination of the outer surface of said hull above said propeller as measured in a cross-sectional plane of said ship through said gas blow openings, at least 0.6

D = the diameter of said propeller, in meters

Q = the total flow of said gaseous medium, in normal cubic meters per hour

P = the power of the drive machinery of said ship, in shaft horsepower

S = 1

Z = the blade number of said driving propeller, and for a multipropeller ship,

D = the average diameter of the driving propellers of said ship, in meters

S = the number of driving propellers of said ship

Z = the blade number of anyone of said driving propellers

B = S, and

P and Q are as defined above for a single propeller ship.

3. A ship according to claim 2, wherein said openings in said groups are aligned in a common vertical plane.

4. A ship according to claim 3, wherein said vertical plane through said openings is disposed at a distance forwards of the plane of the propeller by an amount equal to about 0.3 times the propeller diameter.

5. A method for optimizing the dimensioning of a device for reducing vibration and noise caused in a ship by the driving propeller of said ship, said device including powered means for forcibly blowing gaseous medium through gas blowing openings to a space between said propeller and the hull of said ship in which said gas blowing openings are at different levels, said method including the steps of: feeding the gaseous medium to said openings in groups, each group being limited to openings located substantially at the same level, and setting a different feed pressure for each group for overcoming the water pressure outside the openings, further including dimensioning said powered means and necessary conduits for leading said gaseous medium to said space, so that said means delivers to said space, gas bubbles produced by a total flow of gaseous medium in conformance with the formula:

$$\frac{B \cdot D}{Q} \cdot \sqrt[3]{\frac{P}{S \cdot Z}} < 0.4,$$

wherein, for a single propeller ship,

B = the cosine of the average angle of inclination of the outer surface of said hull above said propeller as measured in a cross-section plane of said ship through said gas blowing openings, at least 0.6

D = the diameter of said propeller, in meters

Q = the total flow of said gaseous medium in normal cubic meters per hour

P = the power of the drive machinery of said ship, in shaft horsepower

S = 1

Z = the blade number of said driving propeller, and for a multipropeller ship,

D = the average diameter of the driving propellers of said ship, in meters

S = the number of driving propellers of said ship

Z = the blade number of anyone of said driving propellers

B = S, and

P and Q are as defined above for a single propeller ship.

6. A method for optimizing the dimensioning of a device for reducing vibration and noise caused in a ship by the driving propeller of said ship, said device including powered means for forcibly blowing gaseous medium through gas blowing openings to a space between said propeller and the hull of said ship, said method including the steps of: providing gas blowing openings at different levels having different areas in dependence on their location depth, the openings at a deeper level having larger areas, thereby providing a compensation for flow differences due to different discharge speeds caused by unequal hydrostatic pressure outside said openings for overcoming the water pressure outside the openings, dimensioning said powered means and necessary conduits for leading said gaseous medium to said space, so that said means delivers to said space, gas bubbles produced by a total flow of gaseous medium in conformance with the formula:

$$\frac{B \cdot D}{Q} \cdot \sqrt[3]{\frac{P}{S \cdot Z}} < 0.4,$$

wherein, for a single propeller ship,

B = the cosine of the average angle of inclination of the outer surface of said hull above said propeller as measured in a cross-section plane of said ship through said gas blowing openings, at least 0.6

D = the diameter of said propeller, in meters

Q = the total flow of said gaseous medium in normal cubic meters per hour

P = the power of the drive machinery of said ship, in shaft horsepower

S = 1

Z = the blade number of said driving propeller, and for a multipropeller ship,

D = the average diameter of the driving propellers of said ship, in meters

S = the number of driving propellers of said ship

Z = the blade number of anyone of said driving propellers

B = S, and

P and Q are as defined above for a single propeller ship.

* * * * *